US007197272B2

(12) United States Patent
Suzuki

(10) Patent No.: US 7,197,272 B2
(45) Date of Patent: Mar. 27, 2007

(54) IMAGE READING APPARATUS, IMAGE FORMING APPARATUS, IMAGE READING METHOD, AND IMAGE FORMING METHOD

(75) Inventor: Kazuhisa Suzuki, Sagamihara (JP)

(73) Assignees: Kabushiki Kaisha Toshiba, Tokyo (JP); Toshiba Tec Kabushiki Kaisha

( * ) Notice: Subject to any disclaimer, the term of this patent is extended or adjusted under 35 U.S.C. 154(b) by 84 days.

(21) Appl. No.: 10/977,069

(22) Filed: Oct. 28, 2004

(65) Prior Publication Data

US 2005/0095045 A1 May 5, 2005

(30) Foreign Application Priority Data

Oct. 31, 2003 (JP) ..... 2003-372712

(51) Int. Cl.
*G03G 15/00* (2006.01)

(52) U.S. Cl. ..... 399/370; 399/376; 399/388; 399/389

(58) Field of Classification Search ..... 399/370, 399/376, 388, 389; 382/286; *G03G 15/00*
See application file for complete search history.

(56) References Cited

U.S. PATENT DOCUMENTS 6,081,687 A * 6/2000 Munemori et al. ..... 399/374
6,701,124 B2 * 3/2004 Sakai et al. ..... 399/370
2002/0191865 A1 * 12/2002 Yamaguchi et al. ..... 382/297

FOREIGN PATENT DOCUMENTS

JP 11-187207 7/1999

* cited by examiner

*Primary Examiner*—Judy Nguyen
*Assistant Examiner*—Nguyen Q Ha
(74) *Attorney, Agent, or Firm*—SoCal IP Law Group LLP; Steven C. Sereboff; M. Kala Savaiya

(57) ABSTRACT

There is disclosed an image reading process has determining an estimated size of an original based on a width of the original, securing a memory region, the memory region having capacity to hold a maximum image data associated with the estimated size, generating an image data as the original is conveying over the read window, loading the image data into the memory region, after the original passed the read window determining a page size based on the width and the image data.

20 Claims, 6 Drawing Sheets

IMAGE READING APPARATUS, IMAGE FORMING APPARATUS, IMAGE READING METHOD, AND IMAGE FORMING METHOD

CROSS-REFERENCE TO RELATED APPLICATIONS

This application is based upon and claims the benefit of priority from prior Japanese Patent Application No. 2003-372712, filed Oct. 31, 2003, the entire contents of which are incorporated herein by reference.

BACKGROUND OF THE INVENTION

1. Field of the Invention

This invention relates to an image reading apparatus, an image forming apparatus, and an image reading method, each capable of efficiently reading image data by a "sheet through method." The image reading apparatus may determine a temporary size for the image printed on an original fed by an automatic document feeder (hereafter, referred to as an "ADF").

2. Description of the Related Art

Recently, image forming apparatuses such as digital copying machines have improved in performance. Demand is increasing for apparatuses that include an ADF and read image data by the sheet through method.

In the sheet through method, an original is moved over a scanner wherein the scanner is held in place. The image forming apparatus reads image data from the original. The sheet through method differs from the ordinary original scanning method. In an ordinary scanning method, the scanner moves to read image data from an original where the original is on the original table. The sheet through method can read the image data faster than the original scanning method. This is because it omits the time consuming process of placing the original on the original table and then moving the scanner below the original table.

Jpn. Pat. Appln. KOKAI Publication No. 11-187207 discloses an image reading apparatus that performs the sheet through method. The apparatus has an ADF and a charge coupled device (CCD). The ADF feeds an original to the CCD. The CCD is a reading unit held in place. The CCD determines the width of the original when the ADF feeds an original to it. From the width of the original, thus determined, the size of the original can be inferred. For example, if the width is that of A4 size paper sheets, then it is inferred that the original is an A4 size sheet. Hence, the user need not input the data representing the size of the original.

The image data read by the CCD is stored in a memory region. Thereafter, a data file is generated from the image data and recorded on a hard disk or the like. Thus, the apparatus may read the image data from the original, even if the user does not input the data representing the size of the original.

The conventional image reading apparatus can efficiently read the image data from the original even if the user does not input the original size data, as long as the original is of a standard size such as A4 size. When originals of different sizes are stacked on the ADF, however, the CCD fails to determine the size of each original. Consequently, the data file generated from any item of image data read by the CCD from an original sheet may not correspond with the size of another original sheet. This may cause troubles in storing the image data, resulting in inefficient filing and printing of the image data.

BRIEF SUMMARY OF THE INVENTION

A one embodiment of the present invention provides an image reading apparatus characterized by comprising: an automatic document feeder which transports an original; a reading section which is held in place and which reads image data from the original transported by the automatic document feeder; a storage device; a recording section stores the image data in a memory region, generates an image-data file from the image data and records the image-data file in the storage device; and a control section which controls the automatic document feeder, the reading section and the recording section.

DETAILED DESCRIPTION OF THE INVENTION

Throughout this description, the embodiments and examples shown should be considered as exemplars, rather than limitations on the apparatus and methods of the present invention.

An image reading apparatus and an image forming apparatus, both according to the present invention, will be described in detail with reference to the accompanying drawings.

<Image Forming Apparatus>

Figure 1:
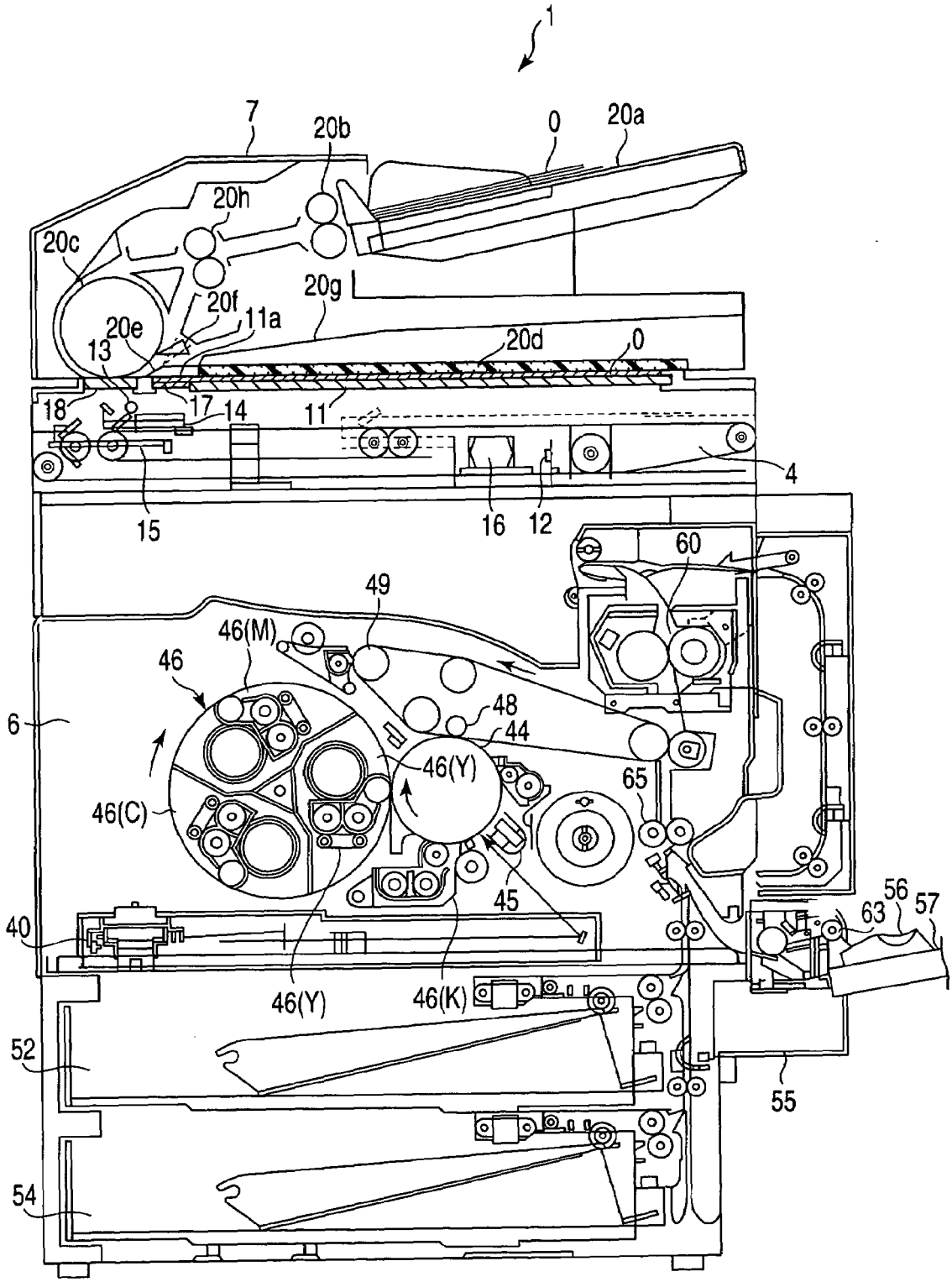
FIG. 1 is a sectional view of an image forming apparatus according to this invention.
Figure 2:
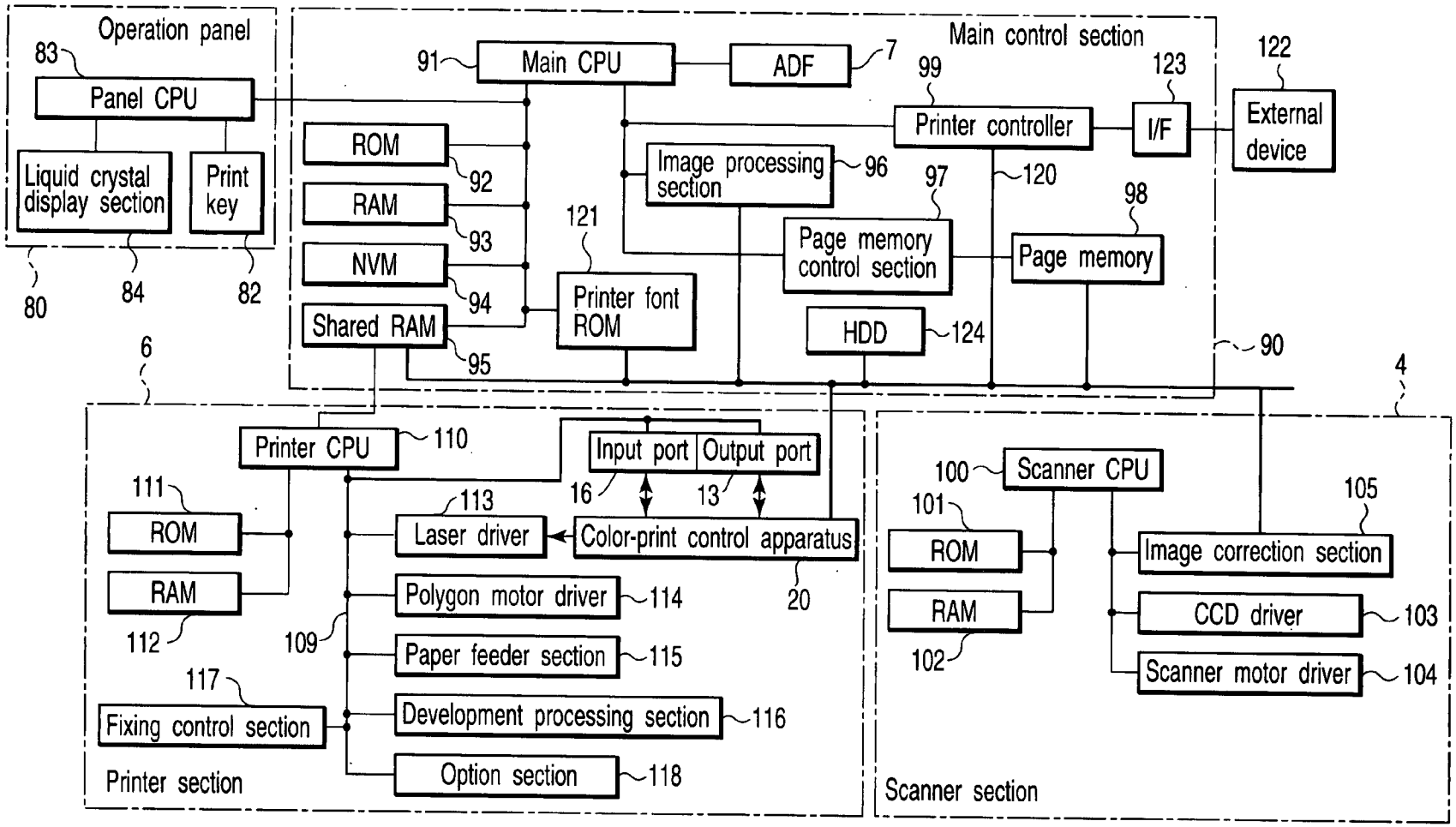
FIG. 2 is a block diagram of the apparatus shown in FIG. 1.

First, an image forming apparatus according to the invention will be described in detail, with reference to FIGS. 1 and 2. FIG. 1 is a sectional view, and FIG. 2 is a block diagram.

(Configuration of the Image Forming Apparatus)

As shown in FIG. 1, a color digital copying apparatus 1, which is an image forming apparatus may include a scanner 4, an image forming unit (MFP) 6, an automatic document feeder (ADF) 7, and an operation panel 80 (not shown). The scanner 4 reads the image printed on an original O, which is to be copied, and generates an image signal representing the image. The MFP 6 forms an image represented by an image signal supplied from the scanner 4 or an external apparatus.

If the original O is a paper sheet, the apparatus 1 may perform a sheet through method. In the apparatus 1, mirrors or image reading sensors and an illuminator unit may be provided at the image reading position. The user may place paper sheets O (i.e., sheets of the original) on the tray 20*a* of the ADF 7. The user may turn on the read start key (not shown). When the read start key is turned on, the ADF 7 may begin feeding the sheets O, one after another, to the image reading position. (Alternatively, an external device may instruct the ADF 7 to start feeding the sheets O.) At the same time, the illumination lamp 13 of a first carriage 14 may emit light, illuminating a white plate 17. The white plate 17 may reflect the light, which is applied to an image retrieving mirror provided or the first carriage 14. The mirror may reflect the light, applying it to a first imaging mirror. The mirror may reflect the light, applying it to a second imaging mirror. The mirror may reflect the light, applying it to a lens 16. The lens 16 may focus the light on the light receiving surface of a CCD sensor 12.

When the read start key is turned on, a motor drive unit (not shown) may drive a motor (not shown), moving the image retrieving mirror in a predetermined direction at an increasing speed. Upon receiving a predetermined number of pulses, the motor may stop so the center of the image retrieving mirror, as viewed in the longitudinal direction, may align with the center of a read window 18. (The longitudinal directions of the mirror and window 18 are perpendicular to the depth direction of the color digital copying apparatus 1). The number of pulses may be determined from, for example, the distance between an HP sensor (not shown) and a shield plate (not shown) provided on the first carriage 14. The number of pulses may be adjusted in accordance with, for example, the inertial torque of the motor, the braking force on the motor, the weight of the first and second carriages, and the tension on the wire rope that is used to move the first carriage 14. The degree to which shading should be corrected may be determined from the intensity of the light reflected from the white plate 17 and may be used to set a threshold value for signals output from the CCD sensor 12.

The ADF 7 may include feed rollers 20*b*, intermediate rollers 20*h* and a transport roller 20*c*. These rollers 20*b*, 20*h* and 20*c* may be driven, feeding the topmost one of the paper sheets O placed on the tray 20*a* to the image reading position. At the image reading position, the transport roller 20*c* may oppose the read window 18.

At a predetermined timing, for example when the transport roller 20*c* starts rotating, the illumination lamp 13 provided on the first carriage 14 may be turned on. The light emitted from the lamp 13 may pass through the read window 18. Hence, a light beam having a rectangular cross section extending in the direction of depth of the lamp 13 may be applied to the paper sheet O that is passing by the read window 18. The paper sheet O is therefore illuminated.

The paper sheet O may reflect the light, which travels to the image retrieving mirror. The mirror may reflect the light to the first imaging mirror. The mirror may reflect the light to the second imaging mirror, thereby guiding the light to the lens 16. The lens 16 may focus the light on the light receiving surface of the CCD sensor 12.

Thereafter, as the transport roller 20*c* is rotated, the other paper sheets O may be fed from the tray 20*a* to the image reading position. At the image reading position, the paper sheets O may be sequentially illuminated with the light coming through the read window 18. The light reflected from the entire surface of each sheet O may be applied to the lens 16, which focuses the light on the light receiving surface of the CCD sensor 12.

The CCD sensor 12 may convert the light coming from the lens 16 to an electric current that is proportional to the intensity of the light. The current is supplied to an analog to digital (A/D) conversion/threshold circuit (not shown). The circuit may first convert the current to a voltage and then converts the voltage to digital data in accordance with a predetermined threshold value. The digital data, or image data that represents the image (text data or image data) printed on the paper sheet O may be stored into an image memory. The image data may represent a monochromic or a color image.

The image on each paper sheet (original) may be a monochromic or a color one. Any monochromic image can be read twice as quickly as image data that represents a color image. This is because it takes much time to process the red (R), green (G), and blue (B) components of the light.

The ADF 7 may include a pickup section 20*e*, claws 20*f*, and a sheet holder 20*g*. The pickup section 20*e* may pick up any paper sheet O that has passed the read window 20. The claws 20*f*, which are tilted to the position indicated by solid lines in FIG. 1, may guide the paper sheet O from the pickup section 20*e* onto the sheet holder 20*g*.

The first paper sheet O may have images printed on both sides. In this case, after the image printed on one side has been read, a claw control section (not shown) moves the claws 20*f* to another position indicated by broken lines in FIG. 1. As a result, the paper sheet O may be fed back to the read window 18 by the feed rollers 20*b*, intermediate rollers 20*h* and transport roller 20*c*, with its other side opposing the read window 18.

If the second paper sheet O has images printed on both sides, it is fed back to the read window 18 in the same way as the first paper sheet.

It has been described how the ADF 7 operates to feed paper sheets O, one after another, to the image reading position. Nonetheless, the ADF 7 may sequentially feed paper sheets O to the original table 11. In this case, it is, of course, determined whether any paper sheet thus placed on the original table 11 has a color image or a monochromic image printed on it.

The color digital copying apparatus 1 may include a printer section 6. The printer section 6 may include a laser exposure unit. The laser exposure unit, which acts as latent image forming means, may include a semiconductor laser, a polygon mirror, a polygon motor, and an optical system. The semiconductor laser may be a light source. The polygon mirror may be a scan member that continually deflects the laser beam that the semiconductor laser emits. The polygon motor may be a scan motor that rotates the polygon mirror at a predetermined speed. The optical system may receive the laser beam reflected by the polygon mirror and deflect the beam, guiding the beam to a photosensitive drum 44 provided in the color digital copying apparatus 1.

The photosensitive drum 44 may be an image carrier located at the center in the housing of the apparatus 1. The laser exposure unit 40 may apply a laser beam to the peripheral surface of the drum 44, forming an electrostatic latent image on the peripheral surface of the drum 44. An electric charger 45, a developing unit 46, and a transfer charger 48 may be arranged around the photosensitive drum 44. The electric charger 45 electrically charges the peripheral surface of the drum 44 to a predetermined level. The developing unit 46 applies toner, i.e., developing agent, to the electrostatic latent image formed on the photosensitive drum 44, thus changing the latent image to a toner image at a desired density. The transfer charger 48 may transfer the toner image formed from the photosensitive drum 44 to a copy paper sheet, thus copying the image printed on a paper sheet O.

A lower part of the housing of the apparatus 1 may include an upper cassette 52 and a lower cassette 54, which can be removed from the housing of the apparatus 1. The cassettes 52 and 54 may lie one above the other. A large capacity feeder 55 is arranged besides the cassettes 52 and 54. A paper feed cassette 57, which serves as a manual insertion tray 56 as well, may be provided above the large capacity feeder 55 and can be removed.

A pair of registration rollers 65 may be provided upstream of the photosensitive drum 44. The registration rollers 65 may set a tilt copy paper sheet in the right position. More precisely, they may align the leading edge of the copy paper sheet with one edge of the toner image on the photosensitive drum 44. The rollers 65 may feed the copy paper sheet to a transfer belt unit 49 at the same speed as the circumferential speed of the photosensitive drum 44 that is rotating.

An operation panel 80 may be provided on the front of the upper front part of the apparatus housing. The user may operate the panel 80 to input, for example, various copying conditions, a copy start signal, and the like. When the copy start signal is input, the color digital copying apparatus 1 may start the sequence of copying the images on paper sheets (original) O.

As FIG. 2 shows, the operation panel 80 may include a print key 82, a panel CPU 83, and a liquid crystal display section 84. When depressed, the print key 82 may generate a copy start signal. The liquid crystal display section 84 may display the number of paper sheets O (original) and the number of copies to be made. The section 84 may display operation guidance, too, showing what the user should do to select a copy magnification, to edit the images to be copied, and so forth. The liquid crystal display section 84 has a touch panel.

<Electrical Configuration of the Image Forming Apparatus>

As FIG. 2 shows, the color digital copying apparatus 1 may include three central processing units (CPUs), which are a main CPU 91, a scanner CPU 100 and a printer CPU 110. The main CPU 91 may be provided in a main control section 90. The scanner CPU 100 may be incorporated in the color scanner section 4. The printer CPU 110 may be used in the color printer section 6. The main CPU 91 performs bidirectional communication with the printer CPU 110 via a shared RAM 95. The main CPU 91 gives various operation instructions to the printer CPU 110. The printer CPU 110 may send status data to the main CPU 91. The scanner CPU 100 may perform serial communication with the printer CPU 110. The printer CPU 110 may provide operation instructions to the scanner CPU 100. The scanner CPU 110 may supply status data to the printer CPU 100.

The operation panel 80 may be connected to the main CPU 91. The main control section 90 may include a ROM 92, a RAM 93, a nonvolatile random access memory (NVM) 94, an image processing section 96, a page memory control section 97, a page memory 98, a printer controller 99, a printer font ROM 121 and an HDD 124, in addition to the main CPU 91 and the shared RAM 95.

The main CPU 91 may control some of the other components of the main control section 90. The ROM 92 may store control programs. The RAM 93 may temporarily store data for controlling the ADF 7.

The NVM 94 is a nonvolatile memory driven by a battery (not shown). It holds data even after the power supplied has been disconnected.

The shared-RAM 95 may be used to achieve the communication between the main CPU 91 and the printer CPU 110.

The page memory control section 97 may write and read, for example, image data, into and from the page memory 98. The page memory 98 may include a memory region that can store image data for a plurality of pages. It may store the compressed image data supplied from the scanner section 4.

The printer font ROM 121 may store font data that represents characters to be printed. The HDD 124 may be connected to the page memory 98 by an image data bus 120. Hence, it may record the file image data loaded into it from the page memory 98.

The printer controller 99 may receive print data from an external device 122 (e.g., a personal computer). Using the font data stored in the printer font ROM 121, the printer controller 99 may develop the print data into image data that has the resolution represented by the data input from an input port 16.

The main control section 90 further has an external interface 123. The external interface 123 may supply various signals to the external device 122 and receives signals therefrom.

The color scanner section 4 may include a ROM 101, a RAM 102, a CCD driver 103, a scanner motor driver 104, a shading correction circuit, and an image correction section 105, in addition to the scanner CPU 100. The scanner CPU 100 may control some of the other components of the color scanner section 4. The ROM 101 may store control programs and the like. The CCD driver 103 may drives a CCD sensor 12. The scanner motor driver 104 may control a motor that moves an exposure lamp and mirrors. The shading correction circuit may correct mismatching between the CCD sensor 12 and an A/D converter circuit. The A/D converter circuit may receive an analog signal from the CCD sensor 12 and convert the signal into a digital signal. The shading correction circuit may also eliminate changes in the threshold value for the signal output from the CCD sensor 12, which result from the changes in the ambient temperature. The image correction section 105 may include a line memory that temporarily stores the shading corrected digital signal output from the shading correction circuit.

The printer section 6 may include a ROM 111, a RAM 112, a laser driver 113, a polygon motor driver 114, a paper feeder section 115, a development processing section 116, a fixing control section 117, an option section 118, and a color print control apparatus 20, in addition to the illumination lamp 13, the input port 16 and the printer CPU 110. The printer CPU 110 may control some of the other components of the color printer section 6. The ROM 111 may store control programs and the like. The laser driver 113 may drive the semiconductor laser mentioned earlier. The polygon motor driver 114 (motor control unit) controls the polygon motor of the laser unit. The paper feeder section 115 may control the travel of paper sheets in a transportation path. The development processing section 116 uses the electrifying charger 45, developer unit 46 and transfer charger 48, thus accomplishing charging, development, and image transfer. The fixing control section 117 may control a fixing unit 60. The color print control apparatus 20 is another embodiment of the present invention.

The image processing section 96, page memory 98, printer controller 99, image correction section 105, laser driver 113 and shared RAM 95 may be connected by the image data bus 120.

<Two Reading Modes in the Image Forming Apparatus>

In an image forming apparatus that has a sheet through type RADF (reverse auto document feeder) and a scanner section which operates in a mixed original stacking mode, image data may be read in two modes. The first reading mode is scan incomplete (size determining) mode, and the second reading mode is scan complete (size estimating) mode. The two reading modes will be explained with reference to the timing chart of FIG. 6.

Figure 6:
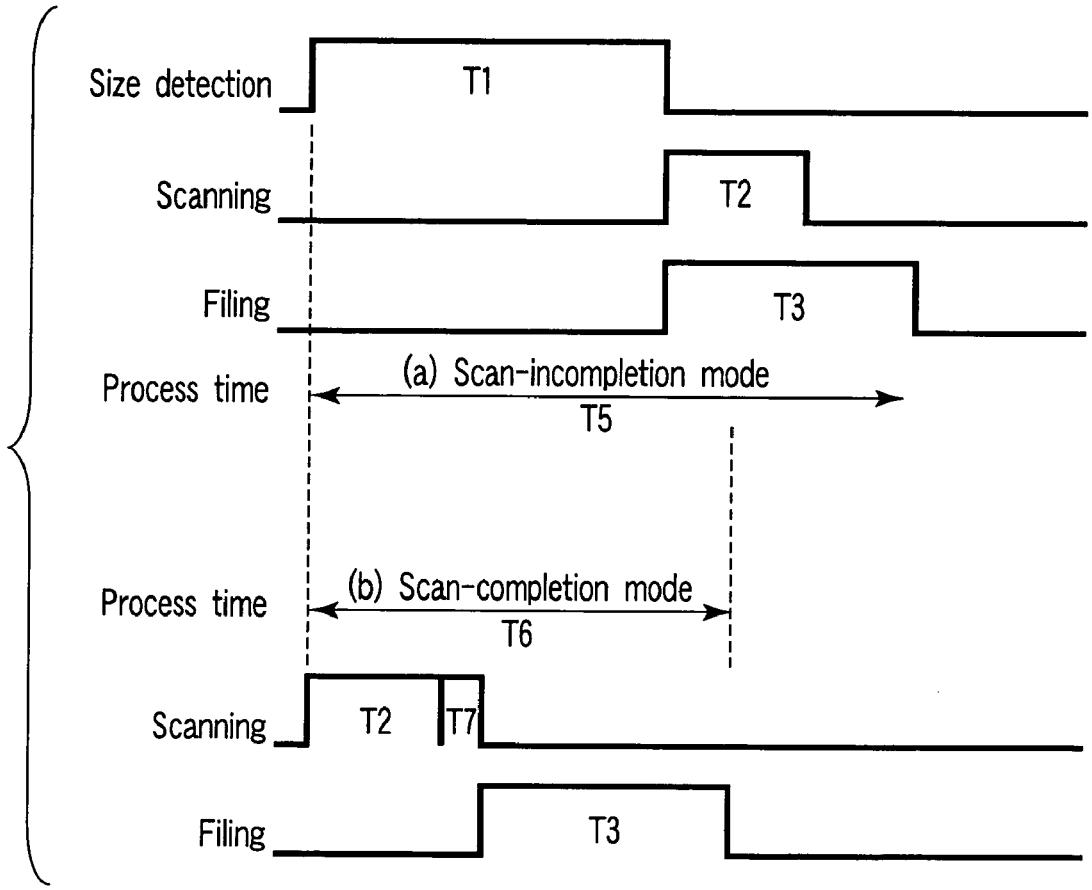
FIG. 6 is a timing chart representing the timing of reading images in the image forming apparatus shown in FIG. 1.

In the scan incomplete (size determining) mode, data filing T3 may be started before the scanning T2 of an original image is completed, as is illustrated in FIG. 6. In this reading mode, the size of the paper sheet (original) must be determined before the image on the paper sheet is scanned. Unless the size of the paper sheet is known, the RADF or the like needs to determine the size of the paper sheet (original)

before the sheet is scanned. This inevitably lengthens the time T6 of reading the image printed on the paper sheet.

The scan complete (size estimating) mode is a reading mode used in the image forming apparatus of the claims. In the scan complete mode, data filing T3 may be started after the scanning T2 of a paper sheet (original) has been completed, as is illustrated in FIG. 6. In this mode, the size of the paper sheet (original) need not be determined before the sheet is scanned. Rather, it suffices to estimate the size of the sheet and secure a memory region in the page memory 98, before the sheet is scanned. The memory region should be large enough to store the image data to be read from the paper sheet. The RADF or the like needs not to determine the size of the paper sheet (original) before the sheet is scanned. This helps to shorten the time T6 required to read the image printed on the paper sheet. In other words, the image can be read at high speed.

In the scan complete (size estimating) mode, even when the original size is unknown, the size of the paper sheet (original) needs not to be detected before scanning the sheet. The size may be estimated prior to the scanning. Thus, inasmuch as (size detecting time T1) (data filing time T3) is a positive value, the image reading time T6 can be shorter than in the scan incomplete (size determining) mode.

When the image is read in the scan complete (size estimating) mode, it may take extra time to finish scanning the paper sheet (original), due to the difference between the estimated size of the sheet and the actual size thereof. Nevertheless, as long as (size detecting time T1) (data filing time T3) (extra scan time T7) is a positive value, the image reading time T6 may be shorter than in the scan incomplete (size determining) mode.

<Operation of the Image Forming Apparatus of the Invention>

An image reading method (i.e., image reading in the scan complete mode) according to this invention will be explained in detail, with reference to FIGS. 3 and 4.

Figure 3:
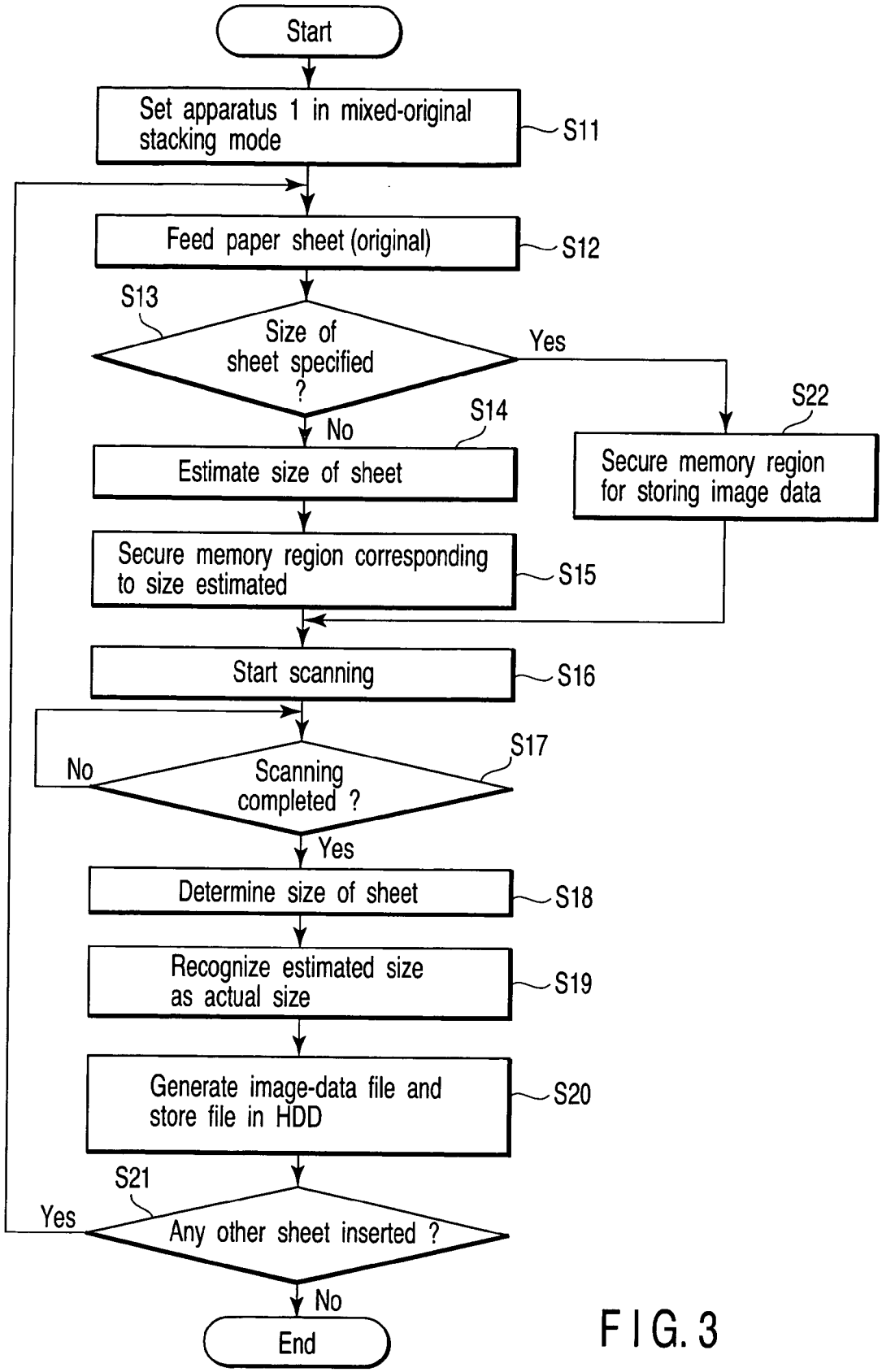
FIG. 3 is a flowchart of an image reading method.
Figure 4:
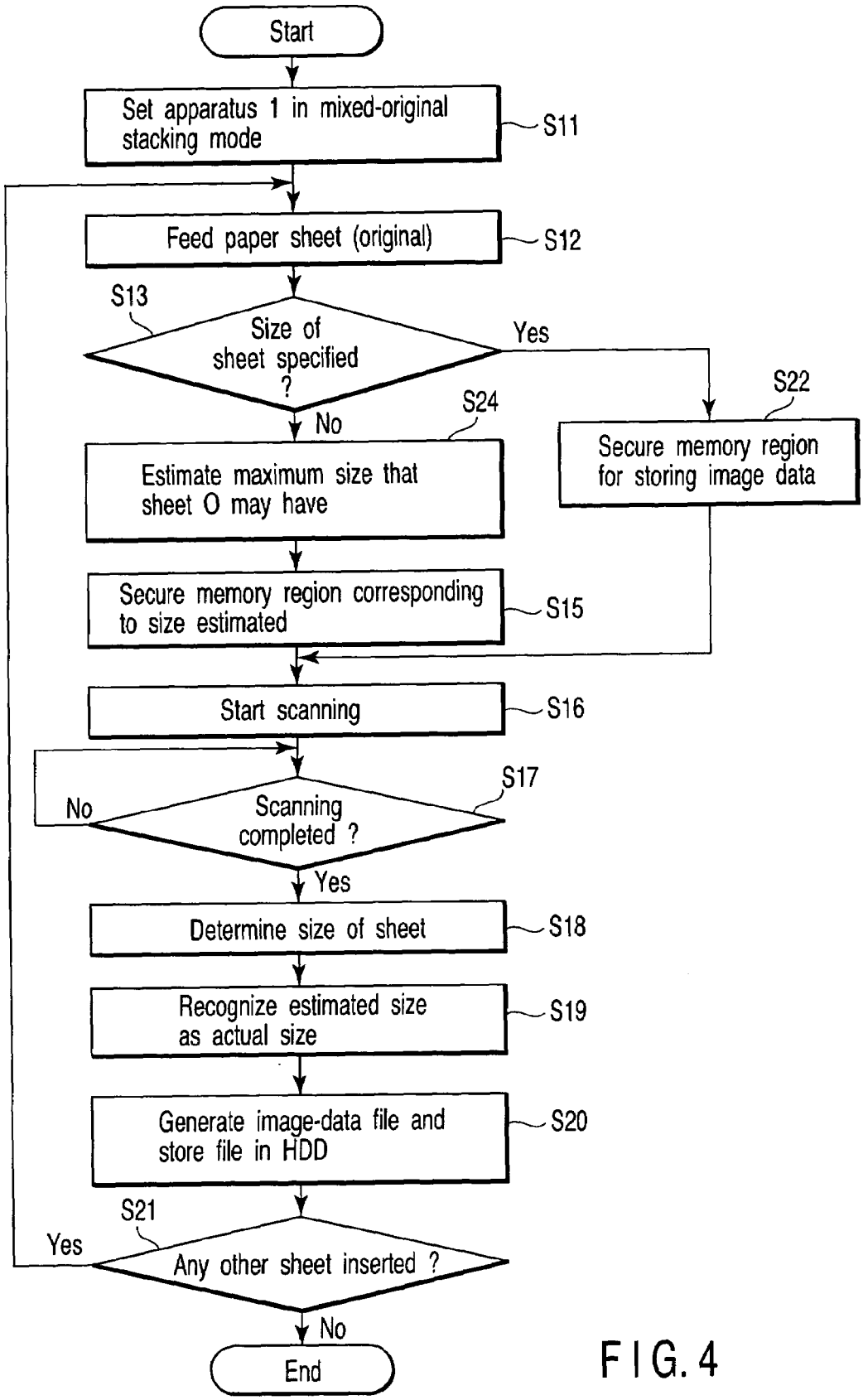
FIG. 4 is a flowchart of an image reading method.
Figure 5:
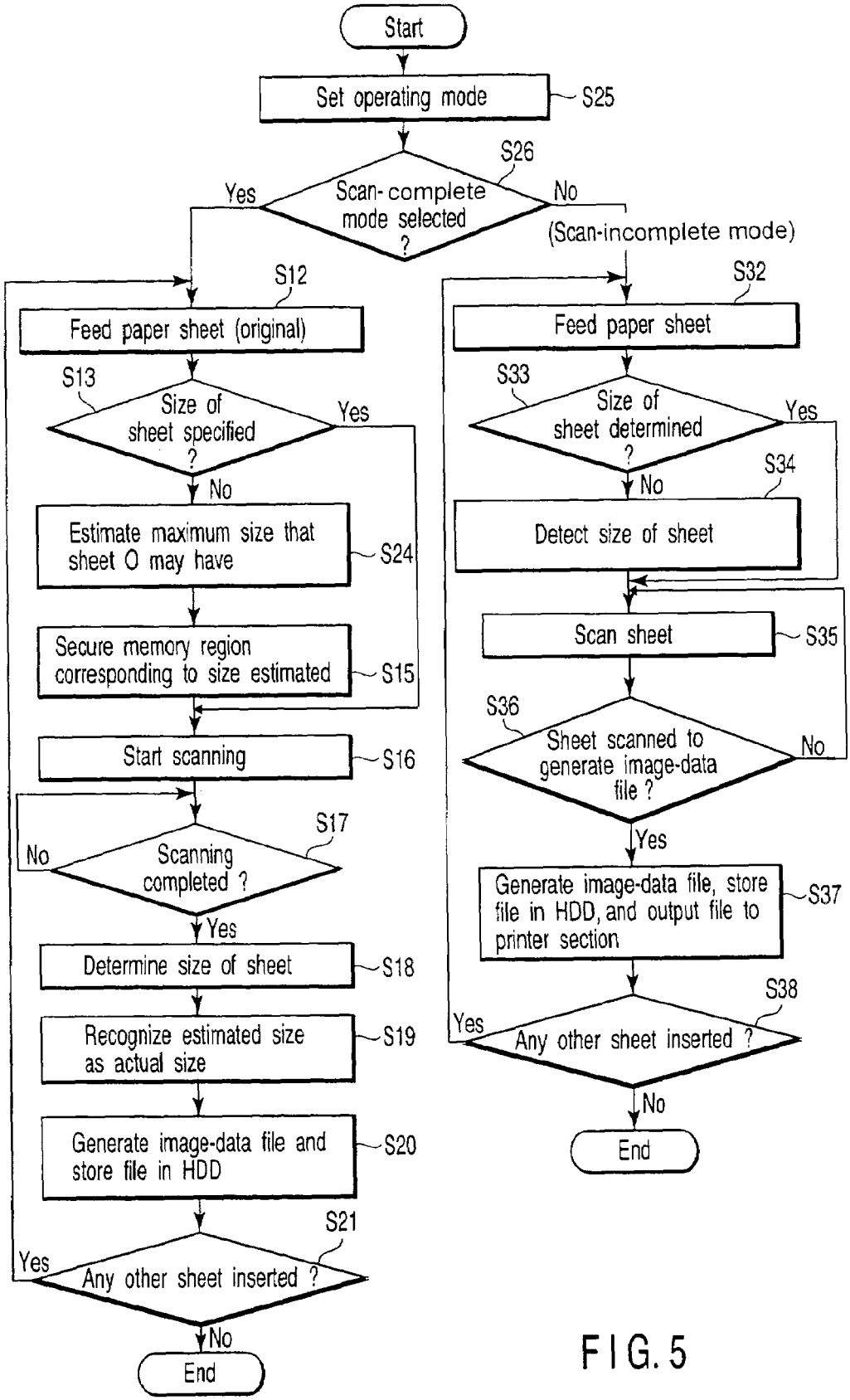
FIG. 5 is a flowchart of an image reading method.

FIG. 3 is a flowchart explaining a method of reading image data in the image forming apparatus. FIGS. 3 and 4 are flowcharts explaining a method of reading image data in the image forming apparatus. FIG. 5 is a flowchart representing two methods of reading image data, which may be employed in the image forming apparatus.

As described above, the image forming apparatus 1 according to the invention may include an ADF 7. While the ADF 7 is feeding a paper sheet O, the image on the sheet is read quickly and reliably by using the sheet through method. In the sheet through method, the CCD sensor 12 may read the image data from the sheet O through the read window 18 while the image forming apparatus remains in the mixed original stacking mode and while the ADF 7 is feeding the sheet O.

In the image forming apparatus 1 of this invention, the main CPU 91 may control the data reading operation in accordance with the program stored in the ROM 92 or the like, as can be understood from FIG. 2. The user may manually insert a paper sheet (original) O into the RADF 7 (i.e., an example of the ADF). In this case, the apparatus 1 is automatically set to the mixed original stacking mode unless the user operates the operation panel 83 to specify the size of the sheet O (S11). Then RADF 7 may begin feeding the sheet O that the user has inserted into it (S12).

It is then determined whether the user has operated the panel 83, thus specifying the size of the paper sheet O (S13). If YES in Step S13, a memory region may be secured in the page memory 98, so that the image data printed on the paper sheet O of the size specified may be stored in the page memory 98 (S22). Then, the paper sheet O may be scanned (S16). If NO in Step S13, the RADF 7 transports the sheet O, and the width of the original O, as measured in a direction perpendicular to the sheet transporting direction, may be detected when the leading edge of the sheet O reaches the read window 18. Thus, the size of the paper sheet O is estimated (S14). The page memory control section 97 controls the page memory 98, securing a memory region in the page memory 98, which is large enough to hold the greatest amount of image data that may be printed on a sheet of the size estimated in Step S14 (S15). While the RADF 7 is transporting the sheet O at an appropriate speed, the CCD sensor 12 may scan the sheet O through the read window 18, generating image data (S16). The image data generated by the CCD sensor 12 is loaded into the page memory 98.

When the paper sheet (original) O is completely scanned, its size may be determined from the amount of image data loaded into the page memory 98 (S18). The size thus determined is recognized as the actual size of the paper sheet O (S19). In accordance with the actual size of the sheet O, thus recognized, an image data file may be generated and stored in the HDD 124 (S20). The image data file is used to copy the image printed on the paper sheet (original) O. Then, it is determined whether any other sheet O has been fed (S21). If NO in Step S21, the process returns to Step S12. Steps S12 to S20 are repeated for any one of the other paper sheets O the user has inserted into the RADF 7.

In the sheet through method described above, neither the AFD nor the RADF needs to detect the size of any paper sheet (original) O in mixed original stacking mode before the sheet O is scanned, unlike in the conventional image forming apparatus. Therefore, the image forming apparatus 1 can read the image data from any paper sheet (original) O faster and more reliably than the convention image forming apparatus.

Another image reading method according to the present invention will be explained, with reference to the flowchart of FIG. 4. This method is identical to the method illustrated in the flowchart of FIG. 3, except for Step S24 of estimating the size of any sheet 0 that has reached the read window 18. In Step S24, the maximum size that the paper sheet O may have is estimated from the width of the sheet O, which the CCD sensor 12 detects when the sheet O reaches the read window 18.

The size of any paper sheet O may be estimated in the following way. The main CPU 91 makes the RAM 93 store the data having the amount of image data read from each sheet O, in association with the data representing the width of the sheet O, which has been detected by the CCD sensor 12. Thus, the RAM 93 holds a database. Then, the size of any sheet O is estimated from the largest amount of image data, recorded in the database.

Also, the user may operate the panel 83, inputting into RAM 94, the widths of various paper sheets available and the sizes of these paper sheets. Alternatively, a correlation table showing various widths that the available paper sheets and the sizes thereof may be prepared and stored in the RAM 93 before the image forming apparatus 1 is shipped from the factory. Otherwise, any other similar method may be employed to store, in the RAM 93, the data showing the sizes of any paper sheets available, in association with the data representing the widths thereof. Then, the RADF 7 need not detect the size of any sheet O. This increases the speed of reading image from the paper sheet O.

(Switching Between the Two Modes)

FIG. 5 is a flowchart explaining still another image reading method that may be performed in the apparatus of FIG. 1. In this method, the image forming apparatus 1 may be set to the scan complete (size estimating) mode and the scan incomplete (size determining) mode.

The user may select the scan complete (size estimating mode). Then, the size of the paper sheet (original) O fed may be estimated and the image data may be quickly read from the sheet O, as in Steps S12 to 21 (FIG. 3).

Nevertheless, it is not always best to operate the apparatus 1 in the scan complete (size estimating mode). Assume that the paper sheet O is scanned at any magnification other than one (1). In this case, the size of the sheet O must be determined and the user needs to select the scan complete mode or scan incomplete mode, whichever is more appropriate.

Thus, as FIG. 5 shows, the user sets the image forming apparatus 1 in the scan complete mode or the scan incomplete mode (S25). Step S26 determines whether the scan complete mode has been selected. If YES, the process goes to Step S12, and Steps S12 to S21 will be performed.

If NO in Step S26, that is, if the scan incomplete mode is selected, the process goes to Step S32. In Step S32, the ADF 7 feeds a paper sheet O (S32). The sheet O may be first turned upside down, and then the other way around, so that its size (i.e., width and length) may be determined. It is determined whether the size of the sheet O has been determined (S33). If NO in Step S33, the RADF may detect the size of the sheet O (S34). Then, the paper sheet O may be scanned (S35). If YES in Step S33, the process jumps to Step S35. Then, it is determined whether the sheet O has been scanned to such an extent that a file of image data may be generated (S36). If YES in Step S36, an image data file is generated, loaded into the HDD 124, and read from the HDD 124 to make a copy of the image printed on the sheet O (S37). If NO in Step S36, the process may returns to Step S35. After Step S37 is performed, whether any other sheet O has been fed is determined (S38). If YES in Step S38, the process may return to Step S32. In this case, Steps S32 to S38 are repeated until images are read from all paper sheets O fed.

As described above and as shown in FIG. 5, the image forming apparatus 1 may be set to the scan complete (size estimating) mode or the scan incomplete (size determining) mode, in accordance with the user's choice.

(Data Reading Speeds)

The speed at which the apparatus 1 reads images from paper sheets (originals) O and the scan complete (size estimating) mode will be described. If the user specifies the A4-R size for sheets O before the sheets O are scanned, the apparatus 1 may read the images in the scan incomplete (size determining) mode at a speed of about 40 sheets/min. If the size of the sheets O is unknown, and the RADF 7 may detect the size of each sheet O before the sheets O are scanned, the apparatus 1 may read the images in the scan incomplete (size determining) mode at a speed of about 15 sheets/min.

If the apparatus 1 reads images from paper sheets (originals) O of unknown size in the scan complete (size estimating) mode of this invention after the size of the sheets O has been estimated, the image reading speed is about 35 sheets/min.

To read images from paper sheets (originals) by the sheet through method, in the mixed original stacking mode, it is better to read the images in the scan complete (size estimating) mode of this invention than to read images in the scan incomplete (size determining) mode. This is because the image reading speed is about 35 sheets/min. in the scan complete mode, whereas the speed is 15 sheets/min. in the scan incomplete mode in which the RADF 7 detects the size of each sheet before the sheets are scanned.

In the apparatus 1, the size of each sheet O, e.g. A4-R, is not determined from the width of the sheet O as is disclosed in Jpn. Pat. Appln. KOKAI Publication No. 11-187207. Rather, the size (FoLio, for example) is estimated from the width of the sheet O before the sheet O is scanned. Upon scanning the sheet O, the size of the sheet may be determined. An image data file may be generated on the basis of the size thus determined (i.e., the amount of image data acquired from the paper sheet O). The image filing process is therefore reliable.

It is easy for those skilled in the art to make various modifications of each embodiment. This invention is not limited to the embodiments described above. Various changes and modifications can be made, without departing from the scope and spirit of the invention.

For example, each embodiment described above is an image forming apparatus that has an HDD for storing the image data in the form of data files. Nonetheless, the HDD can be replaced by any other recording medium.

In the image reading apparatus according to this invention, the CCD sensor may detect the width of a paper sheet (original) and the size of the sheet is estimated before the scanner 4 reads image data from the sheet in the sheet through method. Thus, a memory region corresponds to the sheet size is estimated. The scanner 4 may then start scanning the paper sheet. When the image data is completely read from the sheet, the size of the sheet is reliably determined. On the basis of the sheet size determined, an image data file is generated.

Hence, the sheet (original) need not be turned upside down and then the other way around so that the ADF may scan both sides of the sheet to determine the size thereof, before the CCD sensor reads the image data from the sheet. This shortens the time of processing the paper sheet and ultimately reduces the possibility of damaging the paper sheet.

In the image forming apparatus of this invention, the size of each sheet, e.g. A4 size, is not determined from the width of the sheet as is disclosed in Jpn. Pat. Appln. KOKAI Publication No. 11-187207. Instead, the sheet size is estimated from the width of the sheet before the sheet is scanned. Upon scanning the sheet, the sheet size is determined. On the basis of the sheet size thus determined, an image data file is generated on the basis the size thus determined, after the sheet is scanned in its entirety. Reliable data filing can therefore be achieved in accordance with the amount of image data acquired from the paper sheet.

Thus, the present invention can provide an image reading apparatus that can read image data from paper sheets of various sizes, both quickly and reliably, by the sheet through method.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

What is claimed is:

1. An image reading process comprising:

determining an estimated size of an original based on a width of the original securing a memory region, the memory region having capacity to hold a maximum image data associated with the estimated size generating an image data as the original is conveying over a read window loading the image data into the memory region after the original passed the read window determining a page size of the original based on the width and the image data.

2. The image reading process of claim 1, further comprising providing a mixed size stack of originals.

3. The image reading process of claim 1, wherein the estimated size is determined prior to the original being passed over the read window.

4. The image reading process of claim 1, wherein the estimated size is determined when the page size is unknown.

5. The image reading process of claim 1, further comprising:

generating an image data file based on the page size and the image data.

6. The image reading process of claim 1, operating at a rate of at least 35 pages per minute.

7. The image reading process of claim 1, wherein a second image is formed on a recording medium based on the image data file.

8. The image reading process of claim 1, wherein the estimated size is determined prior to the original being passed over the read window and when the page size is unknown the image reading process further comprises:

providing a mixed size stack of originals operating at a rate of at least 35 pages per minute generating an image data file based on the page size and the image data.

9. The image reading process of claim 8, further comprising:

an image forming section forming an image on a recording medium based on the image data file.

10. An image reading apparatus comprising:

a processor a memory coupled with the processor a storage medium having instructions stored thereon which when executed cause the computing device to perform actions comprising:

detecting a width of an original determining an estimated size of the original based on the width securing a memory region, the memory region having capacity to hold a maximum image data associated with the estimated size generating an image data as the original is conveying over the read window loading the image data into the memory region creating a record in the memory, wherein the record includes the width and the quantity of image data in the memory region after the original passed the read window, determining a page size of the original based on the record.

11. The image reading apparatus of claim 10, wherein the storage medium comprises further instructions to determine the estimated size prior to the original being passed over the read window.

12. The image reading apparatus of claim 10, wherein the storage medium has further instructions to generate an image data file based on the page size and the image data.

13. The image reading apparatus of claim 10, wherein the image reading method operates at a rate of at least 35 pages per minute.

14. The image reading apparatus of claim 10, further comprising:

an image forming section forming an image on a recording medium in accordance with the image data file stored in the storage device.

15. The image reading apparatus of claim 10, wherein the storage medium comprises further instructions to:

determine the estimated size prior to the original being passed over the read window generate an image data file based on the page size and the image data form a second image on a recording medium based on the image data file.

16. An image reading apparatus comprising:

an automatic document feeder which transports an original;

a reading section which reads image data from the original transported by the automatic document feeder;

a recording section stores the image data in a memory region, generates an image data file from the image data and records the image data file in a storage device; and a control section which controls the automatic document feeder, the reading section and the recording section, which estimates the size of the original based on a width of the original, which secures a memory region on the basis of the size estimated, which stores the image data into the memory region secured, which determines the size of the original when the time the reading section finishes reading the entire image data, and which causes the recording section to generate, from the entire image data, an image data file based on the original size determined and to record the image data file into the storage device.

17. The image reading apparatus of claim 16, further comprising:

an image forming section which forms an image on a recording medium in accordance with the image data tile stored in the storage device.

18. The image reading apparatus of claim 16, wherein the estimated size is determined prior to the original being passed over the read window.

19. The image reading apparatus of claim 16, wherein the recording section generates image data files at a rate of at least 35 pages per minute.

20. The image reading apparatus of claim 16, further comprising an image forming section which forms an image on a recording medium, in accordance with the image data file stored in the storage device, wherein the estimated size is determined prior to the original being passed over the read window, and the recording section generates image data files at a rate of at least 35 pages per minute.

* * * * *

UNITED STATES PATENT AND TRADEMARK OFFICE

CERTIFICATE OF CORRECTION

PATENT NO. : 7,197,272 B2
APPLICATION NO. : 10/977069
DATED : March 27, 2007
INVENTOR(S) : Suzuki It is certified that error appears in the above-identified patent and that said Letters Patent is hereby corrected as shown below:

Column 2 line 43, replace "(Configuration of the Image Forming Apparatus)" with --<Configuration of the Image Forming Apparatus>--.

Column 5 line 53, replace "shared-RAM" with --shared RAM--.

Column 8 line 40, replace "0" with --O--.

Column 12 line 44, replace "tile" with --file--.

Signed and Sealed this

Eighth Day of May, 2007

JON W. DUDAS
*Director of the United States Patent and Trademark Office*